US005601231A

United States Patent [19]

Cai

[11] Patent Number: 5,601,231

[45] Date of Patent: Feb. 11, 1997

[54] PARTITIONED MEAL TRAY OR CONTAINER AND BLANK FOR FORMING SAME

[75] Inventor: Liming Cai, West Chester, Pa.

[73] Assignee: Dopaco, Inc., Downingtown, Pa.

[21] Appl. No.: 438,793

[22] Filed: May 11, 1995

[51] Int. Cl.[6] ..... B65D 5/20; B65D 5/4805

[52] U.S. Cl. ..... 229/110; 229/120.17

[58] Field of Search ..... 229/110, 120.17, 229/120.08, 120.12, 120.32

[56] References Cited

U.S. PATENT DOCUMENTS

| | | | |
|---|---|---|---|
| D. 348,609 | 6/1994 | Eisman et al. . | |
| 782,544 | 2/1905 | Carrier | 229/120.17 |
| 2,403,901 | 7/1946 | Belanger | 229/120.12 |
| 2,745,587 | 5/1956 | Vander Lugt, Jr. | 229/120.12 |
| 3,771,713 | 11/1973 | Davidson | 229/120.17 X |
| 3,967,772 | 7/1976 | Baker | 229/110 |
| 4,848,648 | 7/1989 | Eisman . | |
| 4,951,865 | 8/1990 | Eisman . | |
| 5,056,709 | 10/1991 | Cargile, Jr. | 229/120.17 |
| 5,123,588 | 6/1992 | Harris | 229/120.17 X |
| 5,226,587 | 7/1993 | Eisman et al. . | |
| 5,249,736 | 10/1993 | Eisman . | |
| 5,323,958 | 6/1994 | Liu et al. | 229/120.17 |
| 5,326,017 | 7/1994 | Liu et al. . | |
| 5,332,148 | 7/1994 | Liu et al. | 229/120.17 |
| 5,356,070 | 10/1994 | Rigby . | |

FOREIGN PATENT DOCUMENTS

| | | | |
|---|---|---|---|
| 4017399 | 12/1991 | Germany | 229/120.17 |

*Primary Examiner*—Allan N. Shoap
*Assistant Examiner*—Christopher J. McDonald
*Attorney, Agent, or Firm*—Dennison, Meserole, Pollack & Scheiner

[57] ABSTRACT

A partitioned meal tray or container for holding food products is formed from a blank, and comprises a planar base and a plurality of sidewalls, the tray or container further comprising a plurality of internal partitions running parallel to the planar base. Each of the internal partitions has its first end joined either to a respective corner of the tray or to a respective sidewall of the tray, second ends of the internal partitions being joined together. Two embodiments of the tray are hexagonal in shape, while a third embodiment of the tray is pentagonal in shape. Further embodiments of the tray are formed by provision of an additional tray which is insertable into an upper portion of the main tray, the additional tray being supported from below by internal partitions in the main tray. Ends of the internal partitions, adjacent to the corners or walls to which they are connected, comprise a pair of flared tabs which are connected to the corner or wall by glue, adhesive or other means.

19 Claims, 8 Drawing Sheets

PARTITIONED MEAL TRAY OR CONTAINER AND BLANK FOR FORMING SAME

BACKGROUND OF THE INVENTION

In recent years, the fast food or carryout food industry has provided a continually expanding variety of foodstuffs, and has expanded to the point where individual orders frequently consist of separate foodstuffs.

Normally, such separate servings, even if part of a single meal order, will be placed in separate closed containers. As is readily apparent, this not only requires the handling of multiple containers, but also introduces a considerable amount of additional expense when one considers the hundreds of containers which are conceivably used during the day at a typical fast food establishment.

From the ecological standpoint, the necessity of having to dispose of several containers utilized to hold various foodstuffs for a single meal is also not particularly desirable. Thus, the replacement of multiple containers with a single, partitioned meal tray is deemed to be advantageous and desirable from both the economic and ecological perspective.

While such meal trays with partitioned interiors are known in the art, such trays are normally of a substantially rectangular configuration, with the partitions extending from mid-points on the walls of the rectangular container to a central area where they are joined together. Examples of such partitioned food containers are found in Liu et al. U.S. Pat. No. 5,326,017 and Rigby U.S. Pat. No. 5,356,070.

However, such partitioned meal trays of the prior art are not particularly designed for use by the fast food industry. Specifically, the partitioned meal trays disclosed in the two aforementioned patents do not meet the closure requirements of the fast food industry, and in fact do not provide for a closure or cover at all. In addition, such meal trays of the prior art tend to be relatively expensive in fabrication cost, and incorporate materials which would be considered contaminants in any paper recycling process.

A partitioned or multi-compartment container which is more in line with the requirements of the fast food industry is disclosed in Eisman U.S. Pat. No. 4,848,648, which is assigned to the assignee of the present invention. The container disclosed in the latter patent is capable of accommodating multiple foodstuffs of different variety in a single container with an integral locking lid. However, if more than two or three items are to be stored in that container, the length of the container might be considered to be beyond that which can be easily handled, since the compartments are longitudinally aligned.

Thus, as indicated above, the prior art is considered to be lacking in that it does not provide an economically and ecologically acceptable container which is not only capable of being closed but also conveniently sized and configured so that it can accommodate multiple foodstuffs in segregated fashion while still minimizing the overall volume or space taken up by the container.

SUMMARY OF THE INVENTION

The present invention generally relates to a partitioned meal tray or container and blank for forming same. More particularly, the invention relates to a tray or container for holding food products, the tray or container being formed from a blank and comprising a planar base and a plurality of sidewalls, the tray or container further comprising a plurality of internal partitions formed on the planar base, each or most of the internal partitions having a first end joined to a respective corner of the tray or container and a second end joined with the corresponding second ends of the other internal partitions.

In two embodiments of the invention, the tray or container is hexagonal in shape, and three partitions are provided, each partition having a first end fixed to a respective corner of the hexagonal container and a second end joined to the corresponding second ends of the other partitions. In a third embodiment of the invention, the tray or container is pentagonal in shape and has three internal partitions, two of the partitions having a first end fixed to a respective corner of the container, the third partition having a first end fixed to a point along the length of one of the sides of the container, and each of the partitions having a second end joined to the corresponding second ends of the other partitions.

The embodiments of the invention, as thus described, achieve the advantage of economy in size. That is to say, configuration of the tray or container into a pentagonal or hexagonal shape, combined with a carefully chosen arrangement of the partitions, results in a tray or container which can accommodate a maximum number of foodstuffs in a minimal amount of space or area. In addition, the combination of a carefully configured tray or container and equally careful arrangement and connection of the partitions results in a tray or container having a superior degree of structural strength, sufficient to withstand the external forces which are necessarily imposed on the sidewalls and overall structure of the container during loading of the foodstuffs onto the meal tray, transfer of the tray to the customer or recipient, and so forth.

A further feature of the invention resides in the provision, at the first end of one or more of the internal partitions, of a flared set of anchoring tabs. These anchoring tabs are fixed to the corner or wall of the tray or container at the point where the partition is connected thereto, and provide additional strength and durability to the container and its component parts.

In accordance with the invention, each of the aforementioned embodiments is provided with a partition or plurality of partitions having a height substantially less than the height of the sidewalls of the container. As a result, it is possible to place an additional tray into the container, the additional tray being supported by the partition or plurality of partitions. Thus, additional foodstuffs can be placed on the additional tray, and sealed within the container once the lid of the container is closed.

On the other hand, each of the aforementioned embodiments of the invention can be provided with a partition or plurality of partitions having a height equal to the height of the sidewalls. This does not permit the placement of an additional tray into the container, but it does prevent or inhibit foodstuffs in one compartment from moving into another compartment during shipment or transport, thereby intermingling foodstuffs of different type in the same compartment.

Therefore, it is a primary object of the present invention to provide a partitioned meal tray or container and a blank for forming same.

It is an additional object of the present invention to provide a partitioned meal tray or container having a plurality of internal partitions, each or most of which have a first end joined to a respective corner of the tray and a second end joined with the corresponding second ends of the other partitions.

It is an additional object of the present invention to provide a partitioned meal tray or container which is hexagonal in shape, and which has partitions having one end fixed to a respective corner of the tray.

It is an additional object of the present invention to provide a partitioned meal tray or container which is pentagonal in shape and has internal partitions, two of which have an end fixed to a respective corner of the tray, and a third of which has an end fixed to one of the sides of the tray.

It is an additional object of the present invention to provide a partitioned meal tray or container having internal partitions provided, at their ends, with a flared set of anchoring tabs.

It is an additional object of the present invention to provide a partitioned meal tray or container having partitions of a height less than the height of the sidewalls, thereby permitting an additional tray to be inserted into the container for holding additional foodstuffs.

It is an additional object of the present invention to provide a partitioned meal tray or container having internal partitions which have a height substantially equal to the height of the sidewalls, thereby avoiding the intermingling of food during movement of the tray.

Other objects and advantages of the invention will become clear from the details of the invention, as more fully hereinafter described and claimed.

DESCRIPTION OF PREFERRED EMBODIMENT

The invention will now be described in more detail with reference to the various figures of the drawings.

Figure 1:
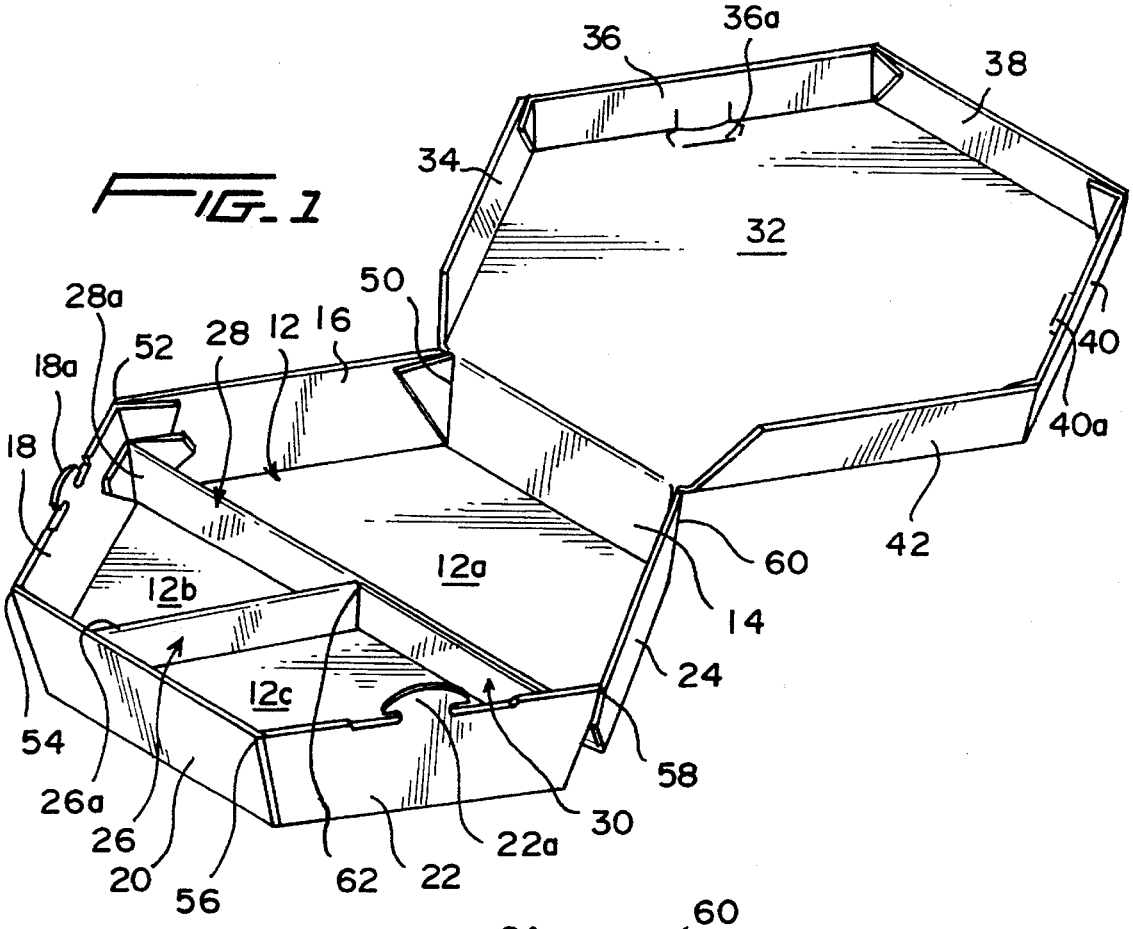
FIG. 1 is a right side perspective view of the top of an open tray in accordance with a first embodiment of the invention.
Figure 2:
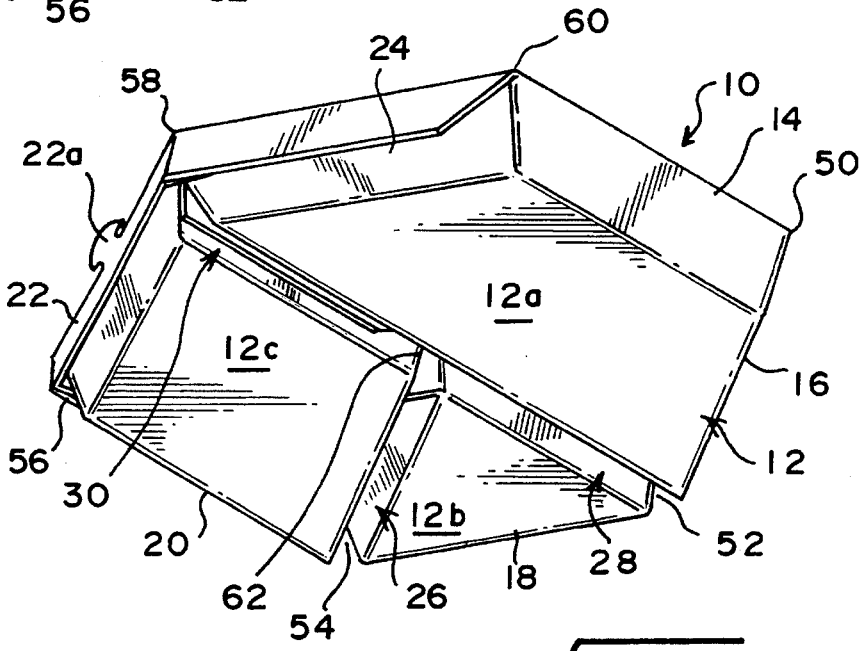
FIG. 2 is a right side perspective view of the bottom of a closed tray in accordance with the first embodiment of the invention.
Figure 3:
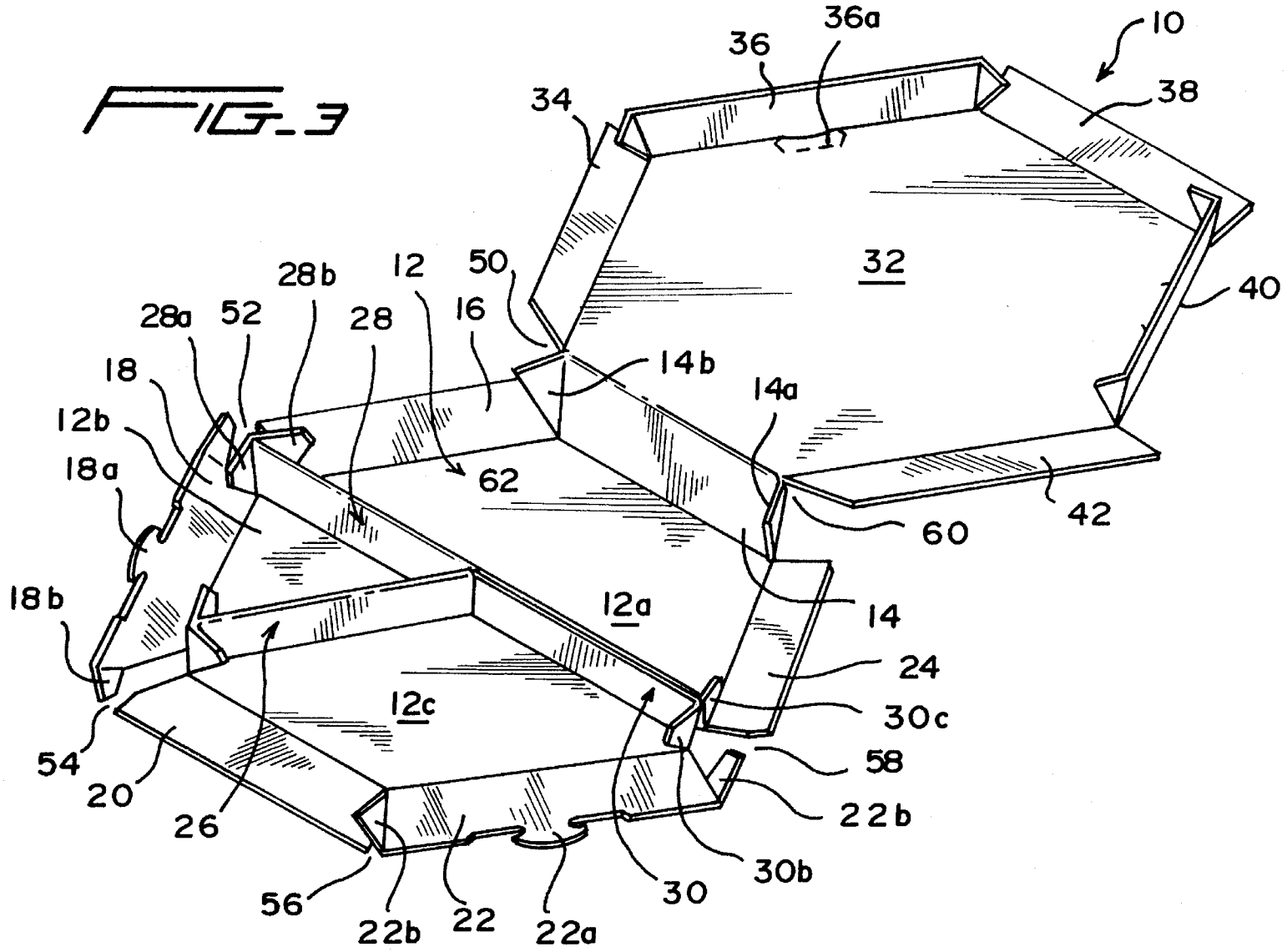
FIG. 3 is a right side perspective view of a partially assembled open tray in accordance with the first embodiment of the invention.

FIG. 1 is a right side perspective view of the top of an open tray in accordance a first embodiment of the invention, FIG. 2 is a right side perspective view of the bottom of a closed tray in accordance with the first embodiment of the invention, and FIG. 3 is a right side perspective view of a partially assembled open tray in accordance with the first embodiment of the invention.

As seen in FIGS. 1–3, the partitioned meal tray or container 10 generally comprises a planar base 12, sidewalls 14, 16, 18, 20, 22 and 24 forming a periphery of the container 10, internal partitions 26, 28 and 30, and a lid or cover 32 having sidewalls 34, 36, 38, 40 and 42 (corresponding to the sidewalls 16, 18, 20, 22 and 24, respectively, of the base 12).

Sidewalls 14 and 16 are angularly oriented with respect to each other so as to form a corner 50 therebetween. Similarly, sidewalls 16 and 18 are angularly oriented relative to each other so as to form a corner 52 therebetween. The same is true with respect to sidewalls 18, 20, 22 and 24, so that corners 54, 56, 58 and 60 are formed between adjacent sidewalls.

Partitions 26, 28 and 30 divide the base 12 into compartments 12*a*, 12*b* and 12*c*. In this embodiment of the present invention, partitions 26, 28 and 30 have first ends 26*a*, 28*a* and 30*a* joined to corners 54, 52 and 58, respectively, the other ends of partitions 26, 28 and 30 being joined at a common point 62. The interconnection of ends 26*a*, 28*a* and 30*a* with corners 54, 52 and 58, respectively, will be discussed in more detail below relative to FIG. 5. At this point, it is sufficient to state that the described interconnection, as well as the arrangement of partitions 26, 28 and 30, is such as to provide the container 10 with improved rigidity and stability relative to prior containers.

Figure 4:
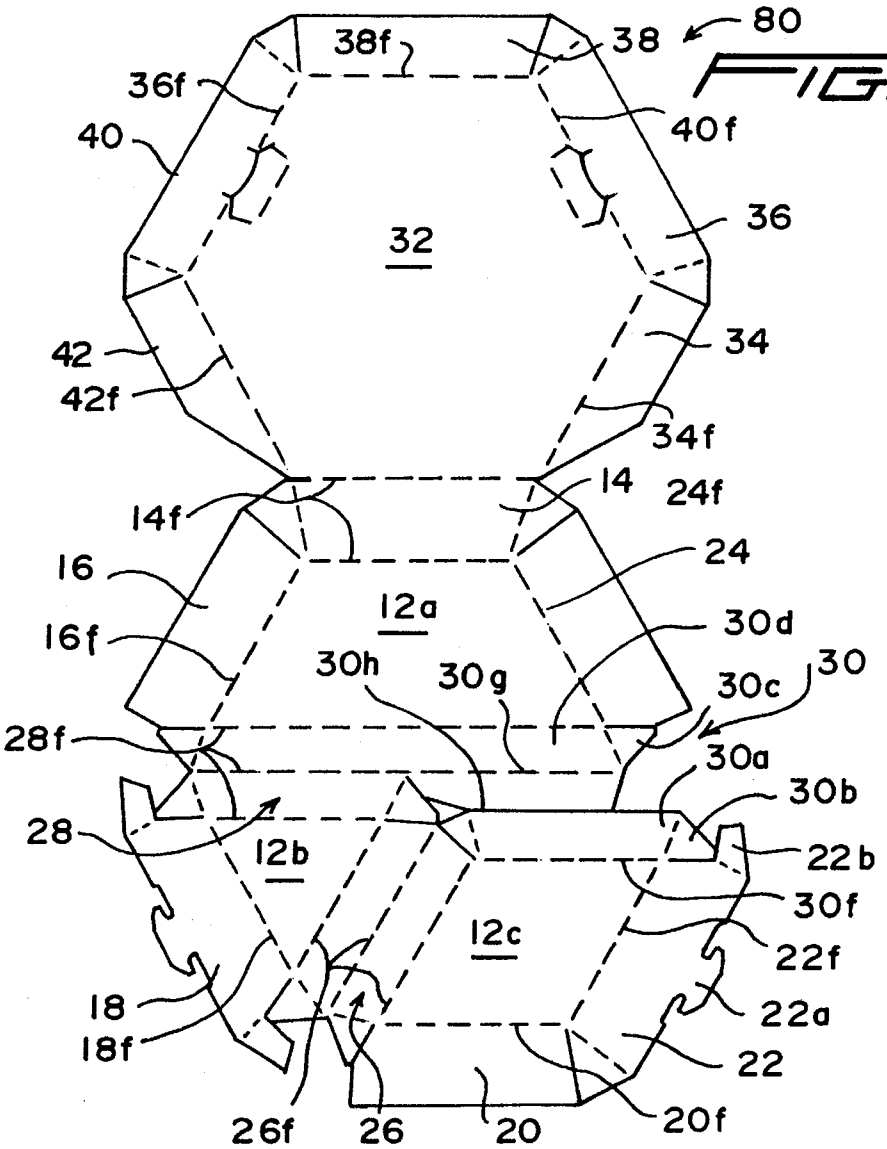
FIG. 4 is a planar view of the blank used in assembling the tray of FIGS. 1–3.

FIG. 3 is a perspective view of a partially assembled meal tray in accordance with the first embodiment of the invention, while FIG. 4 is a plan view of a blank used in assembling the tray of FIGS. 1–3. The blank 80 comprises portions corresponding to the previously described components of the container of FIGS. 1 and 2, and thus common reference numerals have been used where appropriate.

The blank 80 of FIG. 4 contains foldable portions 26, 28 and 30, portion 30 comprising further portions 30*b* and 30*d* separated by cutline 30*h*. In forming the container 10 of FIGS. 1–3, portions 26, 28 and 30*d* are folded along respective fold lines 26*f*, 28*f* and 30*f* so as to assume the shape of inverted V's (see FIG. 5), thereby forming interior partitions 26 and 28 and part of partition 30 (FIG. 1). Sidewalls 14, 16, 18, 20, 22 and 24 (FIG. 4) are folded along corresponding fold lines 14*f*, 16*f*, 18*f*, 20*f*, 22*f* and 24*f* to form sidewalls 16, 18, 20, 22 and 24 (FIG. 1). Similarly, sidewall portions 34, 36, 38, 40 and 42 (FIG. 4) are folded along fold lines 34*f*, 36*f*, 38*f*, 40*f* and 42*f* to form sidewalls 34, 36, 38, 40 and 42 of the top or lid 32 of the container 10 (FIG. 1).

Referring to FIG. 3, it should be noted that, in raising the sidewalls, corners 50, 52, 54, 56, 58 and 60 are formed.

Certain corners, such as corners 50, 54, 56 and 60 of the base 12 are formed by folding tabs 14*a*, 14*b*, 18*b* and 22*b* so that those tabs overlap adjacent end portions of walls 24, 16 and 20, respectively, and the tabs are then fixed to the corresponding end portions of the adjacent sidewalls by glue, adhesive or other appropriate means. In accordance with the invention, corners 52 and 58 are formed by folding tabs 28*a*, 28*b*, 30*b* and 30*c* located at corresponding end portions of the internal partitions 28 and 30, respectively, so that those tabs portions overlap corresponding end portions of the sidewalls 18, 16, 22 and 24, respectively, the tab portions 28*a*, 28*b*, 30*b* and 30*c* being fixed to the corresponding end portions of the sidewalls 18, 16, 22 and 24, respectively, by glue, adhesive or other appropriate means.

Figure 5:
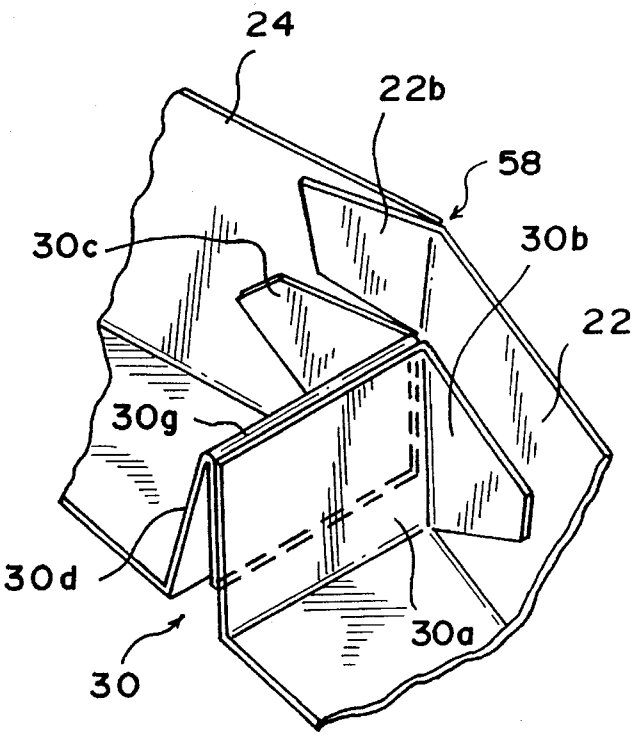
FIG. 5 is a detailed perspective view of a corner of the tray of FIGS. 1–3.

FIG. 5 is a detailed perspective of the corner 58 of the container 10 of FIG. 3. Referring to FIGS. 4 and 5, it is seen that internal partition 30 is formed from an end portion 30*a*, which is equipped with flared out tab 30*b* just described, and from portion 30*d* which is folded along fold line 30*g* to form an inverted V. As seen best in FIG. 5, as the container 10 is assembled, the portion 30*a* is folded along fold line 30*f* so as to assume a vertical position, the portion 30*a* coming to rest against one side of the inverted V formed by portion 30*d*, and the portion 30*a* is fixed to the portion 30*d* by glue, adhesive or other similar means. In addition, the sidewall 22 has a tab portion 22*b* extending toward adjacent sidewall 24. When sidewalls 22 and 24 are raised to assume a vertical orientation, tab 22*b* is fixed to an adjacent end portion of sidewall 24 by glue, adhesive or other means, thereby providing rigidity and stability to the sidewalls of the container 10 of FIGS. 1–3. Additional rigidity and stability are provided by fixing tabs 30*b* and 30*c* of the end portions 30*a* and 30*d*, respectively, of partition 30 to the walls 22 and 24, respectively, by glue, adhesive or other means, as previously described.

It should be noted that rigidity and stability are obtained not only by virtue of the interconnection of tabs 30*b* and 30*c* with walls 22 and 24, respectively, but also from the fact that the walls 22 and 24 are angularly oriented with respect to each other so as to form an acute angle defining the corner 58, and also by virtue of the interconnection of the double-thickness inverted V-shaped portion 30*d* and portion 30*a*. Such an interconnection of the walls 22 and 24 with partition 30 provides a resistance or cushioning effect with regard to any longitudinal crushing forces exerted on the internal partition 30, and such longitudinal forces are much more easily absorbed as a result of this unique arrangement.

Further referring to FIGS. 1 and 2, it should be noted that the cover 32 is provided with slits 36*a* and 40*a*, while the walls 18 and 22 are provided with tabs 18*a* and 22*a*, respectively. These elements facilitate closing of the container 10 in that, as the cover 32 is rotated about an imaginary axis passing through corners 50 and 60, and is then lowered over the base 12, tabs 18*a* and 22*a* pass through the slits 36*a* and 40*a*, respectively, thereby locking the cover 32 in its closed position over the base 12 of container 10.

Figure 6:
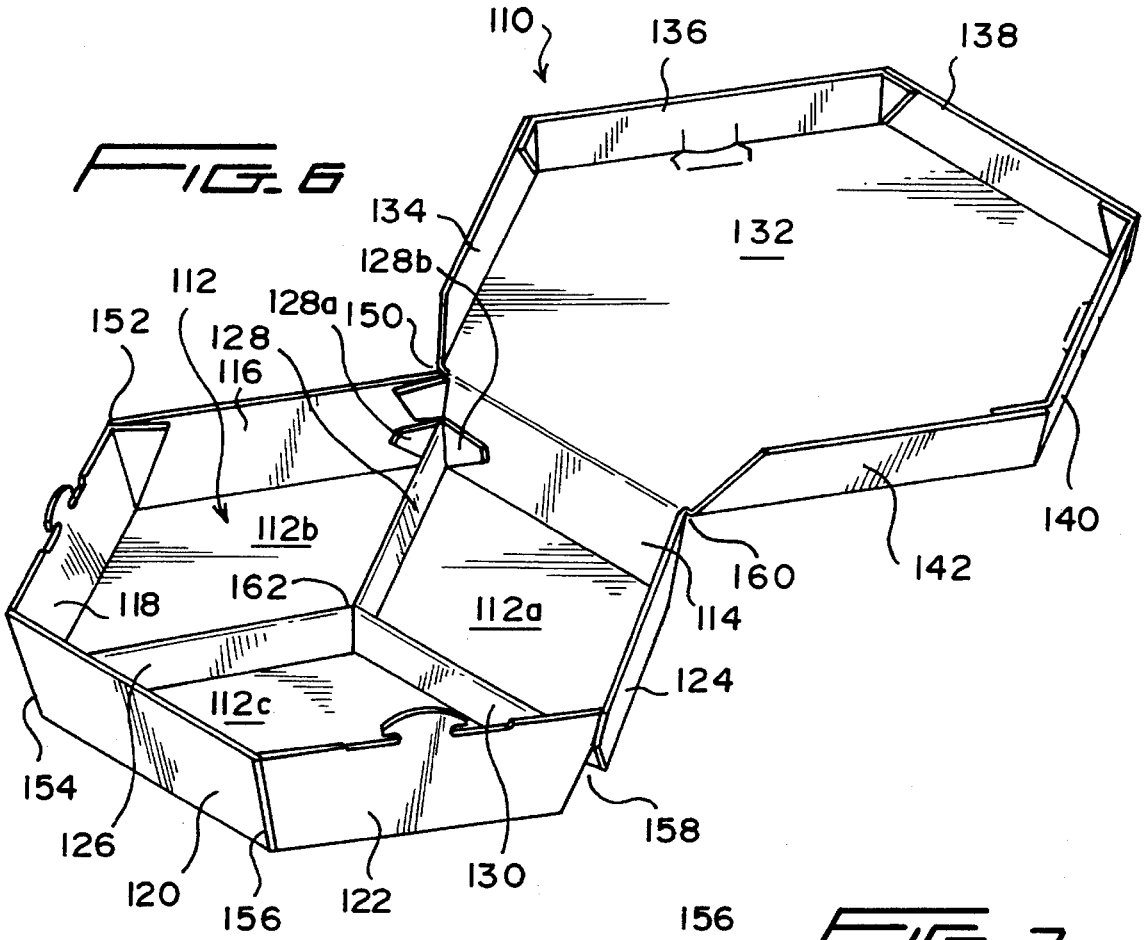
FIG. 6 is a right side perspective view of an open meal tray in accordance with a second embodiment of the invention.
Figure 7:
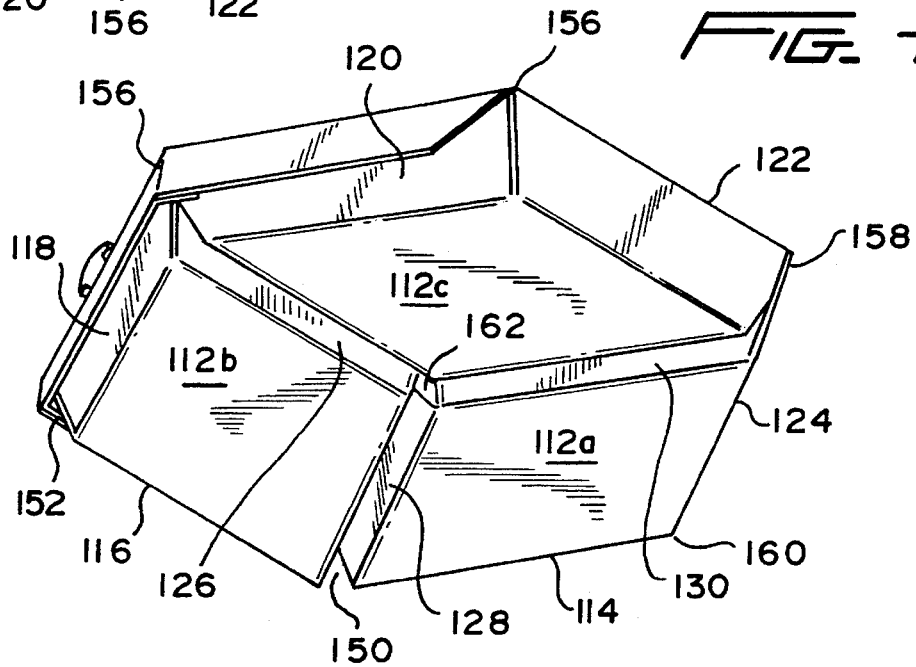
FIG. 7 is a right side perspective view of the bottom of a closed meal tray in accordance with the second embodiment of the invention.
Figure 8:
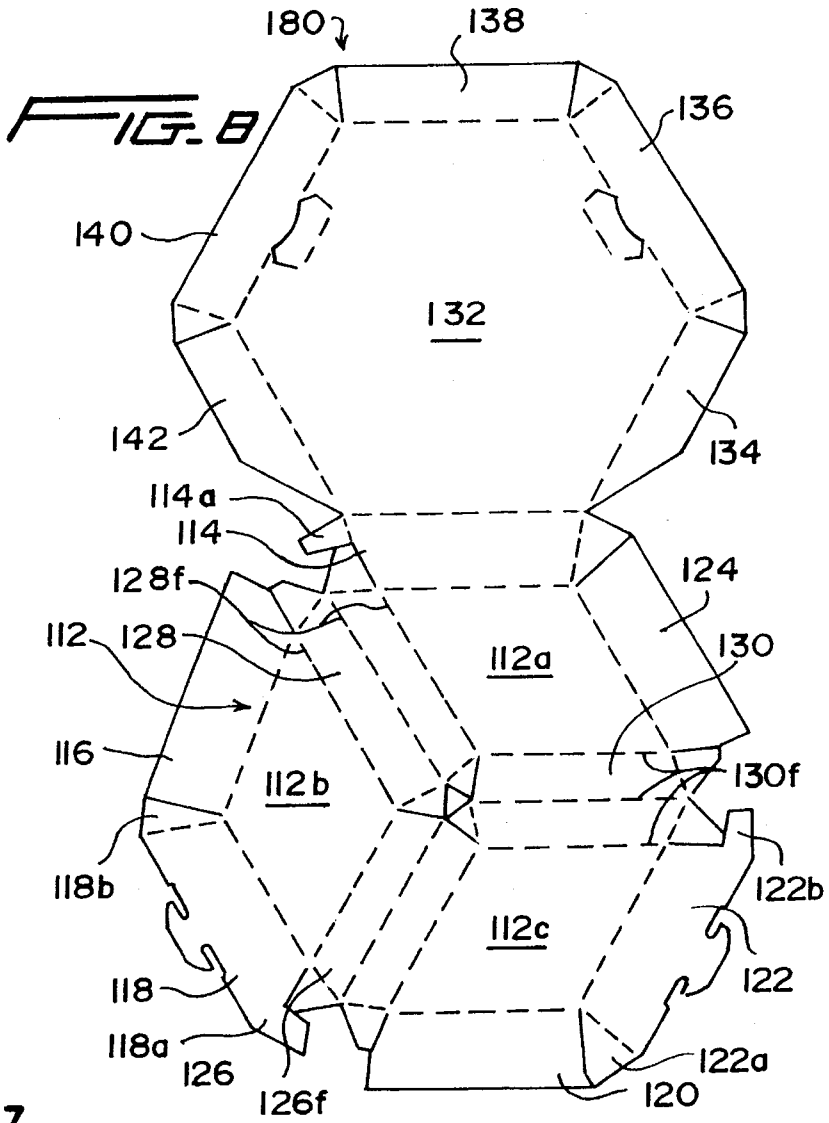
FIG. 8 is a plan view of a blank used in assembling the meal tray of FIGS. 6–7.

FIG. 6 is a right side perspective view of an open meal tray in accordance with a second embodiment of the invention, FIG. 7 is a right side perspective view of the bottom of a closed meal tray in accordance with the second embodiment of the invention, and FIG. 8 is a plan view of a blank used to assemble the meal tray in accordance with the second embodiment of the invention.

As seen in FIGS. 6 and 7, the meal tray or container 110 basically comprises a planar base 112 and a cover 132. The base 112 has sidewalls 114, 116, 118, 120, 122 and 124 forming a periphery of the container 110, while the cover 132 has corresponding sidewalls 134, 136, 138, 140 and 142. The sidewalls 114, 116, 118, 120, 122 and 124 are mutually angularly oriented so that adjacent sidewalls form obtuse interior angles, thereby defining corners 150, 152, 154, 156, 158 and 160. Similarly, the sidewalls 134, 136, 138, 140 and 142 of cover 132 are mutually angularly oriented so as to define interior obtuse angles.

In accordance with the present invention, internal partitions 126, 128 and 130 are formed on the planar base 112 so as to subdivide the planar base 112 into compartments 112*a*, 112*b* and 112*c*. Each of the partitions 126, 128 and 130 has a first end which is connected to a respective corner 154, 150 and 158, respectively, of the container 110, while the second ends of each of partitions 126, 128 and 130 are connected together at a point 162 within the container 110. Moreover, as previously described with reference to FIGS. 1–4, each partition 126, 128 and 130 preferably has, at its first end, flared tabs (such as tabs 128*a* and 128*b* associated with the first end of partition 128) which are joined to respective end portions of adjacent sidewalls (such as sidewalls 116 and 114) by glue, adhesive or other conventional means. As also previously mentioned, this has the advantage of lending stability and rigidity to the container 110.

Referring to FIG. 8, formation of meal tray 10 from the blank 180 of FIG. 8 proceeds in a manner quite similar to that described above relative to the container 10 of FIGS. 1–4. Thus, partition portions 126, 128 and 130 are folded along fold lines 126*f*, 128*f* and 130*f*, respectively, so that the partition portions 126, 128 and 130 assume V-shaped configurations, with the "V" pointing in the upward direction. Similarly, each of the sidewalls 116, 118, 120, 122 and 124 of the base 112 and each of the sidewalls 134, 136, 138, 140 and 142 of the cover 132 are folded along respective fold lines so that the sidewalls are oriented in the vertical direction. Adjacent sidewalls are then joined to each other by the application of glue, adhesive or other means to tabs (such as tabs 114*a* and 118*a* of walls 114 and 118, respectively) and protruding portions (such as portions 118*b* and 122*a* of walls 118 and 122, respectively).

Figure 11:
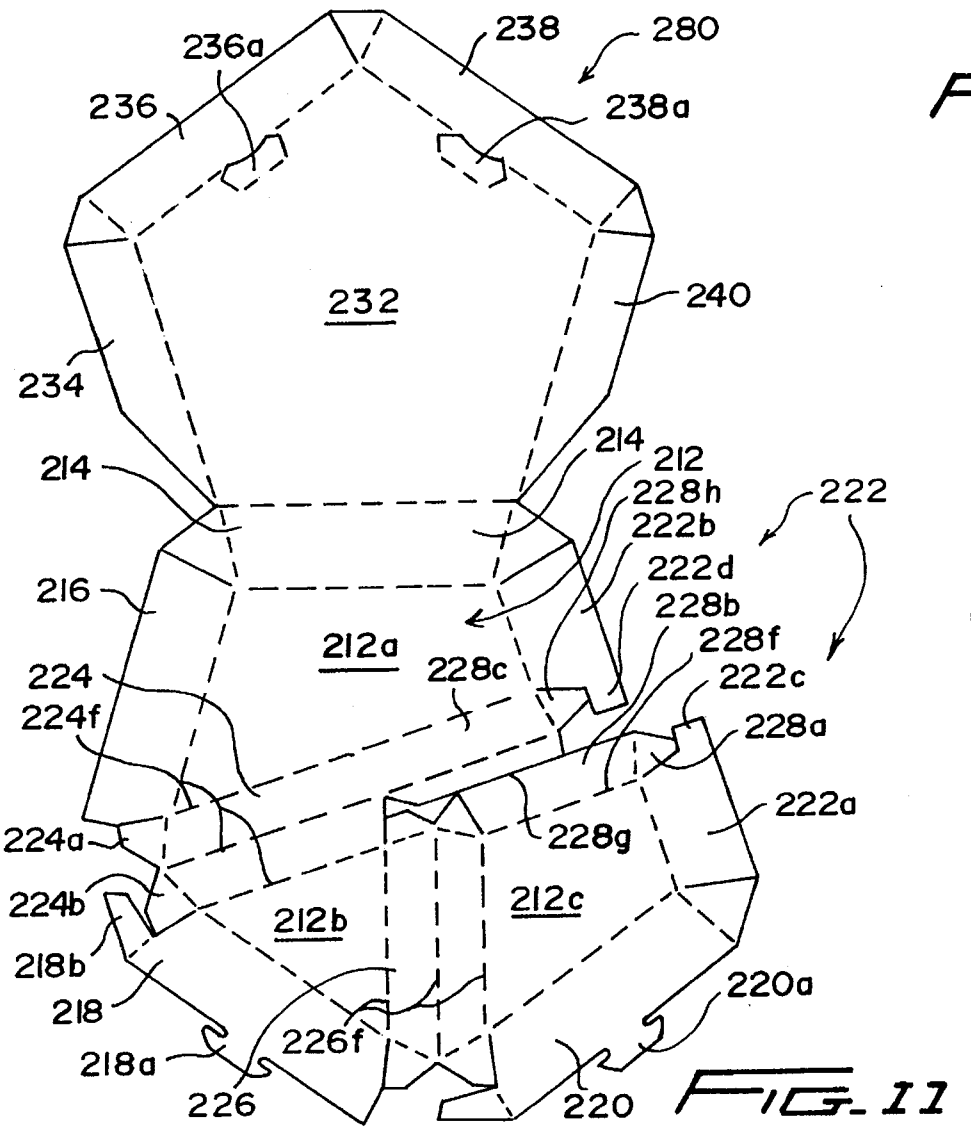
FIG. 11 is a plan view of a blank used in assembling the meal tray of FIGS. 9–10.
Figure 9:
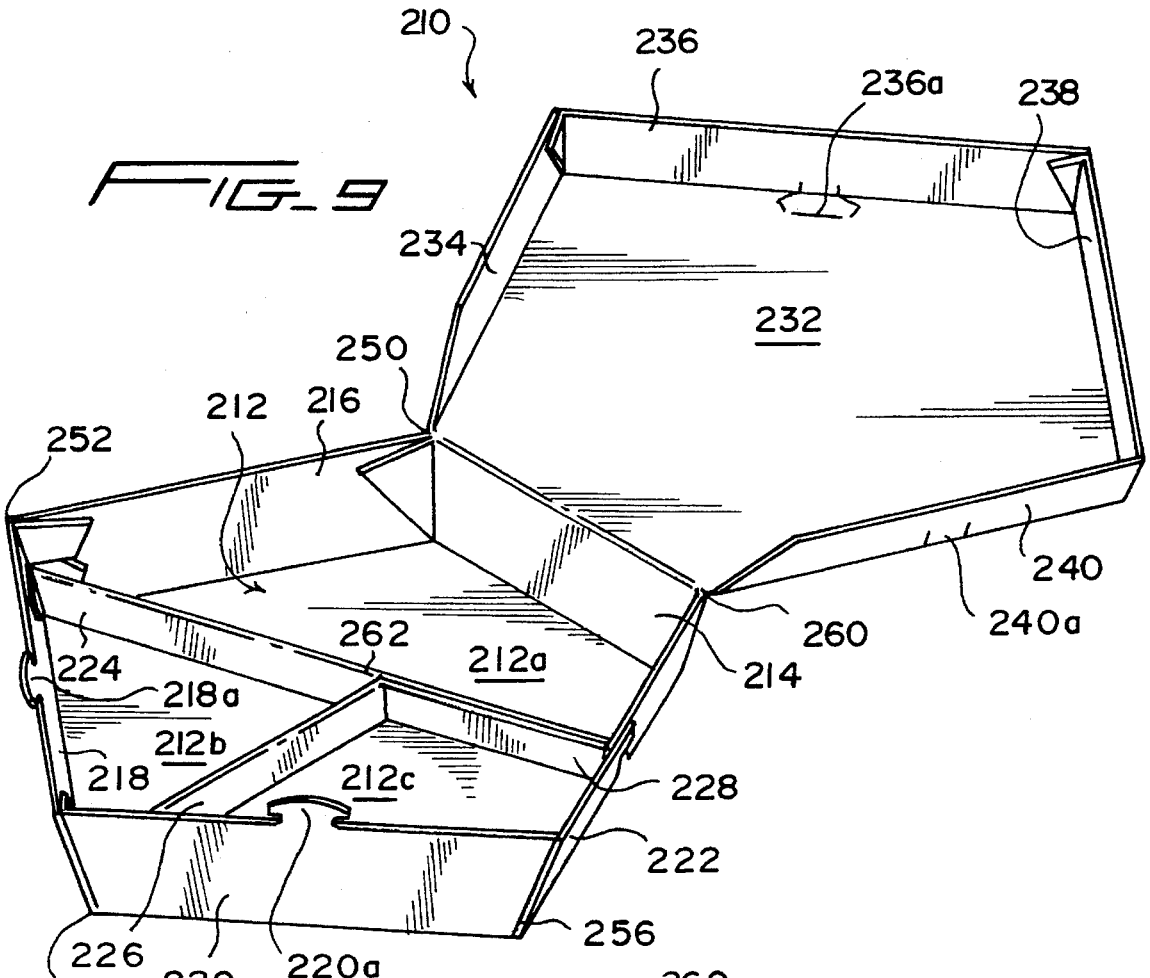
FIG. 9 is a right side perspective view of a meal tray in accordance with a third embodiment of the invention.
Figure 10:
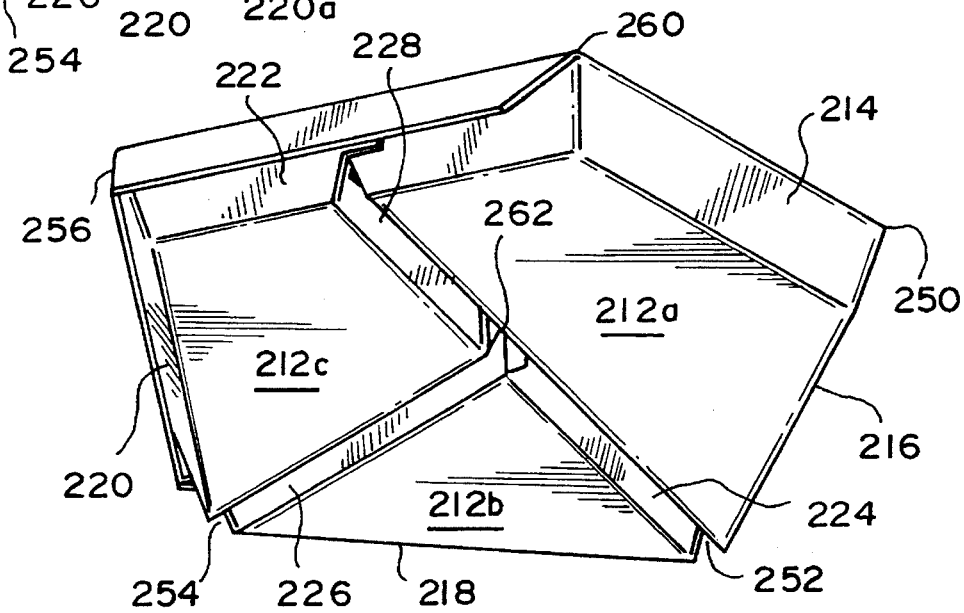
FIG. 10 is a right side perspective view of the bottom of a closed tray in accordance with the third embodiment of the invention.

FIG. 9 is a right side perspective view of an open tray in accordance with a third embodiment of the invention, FIG. 10 is a right side perspective view of the bottom of a closed tray in accordance with the third embodiment of the invention, and FIG. 11 is a plan view of a blank used to form a tray in accordance with the third embodiment of the invention.

As seen in FIGS. 9 and 10, in accordance with this third embodiment of the invention, the container or tray 210 generally comprises a planar base 212 and a cover or lid 232. The planar base 212 is provided with sidewalls 214, 216, 218, 220 and 222 forming a periphery of the container 210, while the cover 232 is provided with corresponding sidewalls 234, 236, 238 and 240. Internal partitions 224, 226 and 228 are formed on the base 212, and subdivide the base 212 into interior compartments 212*a*, 212*b* and 212*c*.

As was the case in the previous embodiments, sidewalls 214, 216, 218, 220 and 222 are angularly oriented relative to each other so as to form interior obtuse angles, the interior obtuse angles constituting corners 250, 252, 254, 256 and 260. However, in contrast to the previous embodiments, which had six sidewalls and six corners, the third embodiment as seen in FIGS. 9 and 10 comprises five corners and five sidewalls.

Internal partitions 224 and 226 have first ends connected to corners 252 and 254, respectively, while partition 228 has a first end connected to a generally central portion of sidewall 222, the second ends of each of the partitions 224, 226 and 228 being interconnected at a point 262 on base 212.

As a result, the base 212 of tray 210 is subdivided into three interior compartments 212*a*, 212*b* and 212*c*, just as previously described trays 10 and 110 of FIGS. 1 and 6, respectively, had bases which were subdivided into three compartments. However, in accordance with this third embodiment of the invention, a five-sided tray (as opposed to a six-sided tray) is employed to provide a more efficient allocation of space within the tray 210, so that the tray 210 takes up less overall space compared to the space taken up by previously described trays 10 and 110 of FIGS. 1 and 6, respectively.

Turning to consideration of FIG. 11, blank 280 generally comprises a tray portion including base portion 212 and a cover portion 232. Base portion 212 includes sidewall portions 214, 216, 218, 220 and 222, with the sidewall portion 222 comprising sub-portions 222*a* and 222*b*. Similarly, cover portion 232 comprises sidewalls 234, 236, 238 and 240.

The base portion 212 is provided with interior wall portions 224, 226, 228*b* and 228*c* (the latter two being separated by cutline 228*g*) and portions 224, 226, 228*b* and 228*c* subdivide the base portion 212 into compartment portions 212*a*, 212*b* and 212*c*. Sidewall portions 218 and 220 of base portion 212 are provided with tab portions 218*a* and 220*a*, respectively, while the cover portion 232 is provided with slit portions 236*a* and 238*a* adjacent to sidewall portions 236 and 238, respectively, the slits 236*a* and 238*a* providing a locking receptacle for inserted tab portions 218*a* and 220*a*, respectively, when the blank 280 is fully assembled to form the container 210 of FIG. 9.

In assembling the blank 280, the portions 224, 226 and 228*c* are folded along fold lines 224*f* and 226*f*, respectively, so that portions 224, 226 and 228*c* become V-shaped, with the V pointing upward. Portion 228*b* is folded along fold line 228*f* so that the portion 228*b* assumes a generally vertical orientation relative to the adjacent inverted V-shaped portion 228*c* of partition portion 228. Wall portions 216 and 218 are joined together by applying glue, adhesive or other means to tab portion 218*b* so that it adheres to wall portion 216. Interior partition portion 224 is then joined to wall portions 216 and 218 by the application of glue, adhesive or other means to tab portions 224*a* and 224*b*, respectively. A similar procedure is followed in connecting partition portion 226 to wall portions 218 and 220. Partition portions 228*b* and 228*c* are connected to sub-portions 222*a* and 222*b* via tab portions 228*a* and 228*h*, respectively, the wall sub-portions 222*a* and 222*b* being interconnected via tab portions 222*c* and 222*d*, each of the latter interconnections being accomplished by the application of glue, adhesive or other means.

It should be noted that, as the container 210 of FIGS. 9 and 10 is assembled from blank 280 of FIG. 11, the vertically oriented portion 228*b* comes to rest against one side of the inverted V-shaped portion 228*c*, and the portion 228*b* is fixed to the inverted V-shaped portion 228*c* by glue, adhesive or other similar means. Thus, a reinforced internal partition 228 is formed in the container 210 of FIGS. 9 and 10 in a manner similar to the procedure by which a reinforced partition 30 was formed in the container 10 of FIGS. 1–3. The result of this unique arrangement is superior resistance to any crushing force which might be exerted upon the walls of the container 210 of FIGS. 9 and 10.

Figure 12:
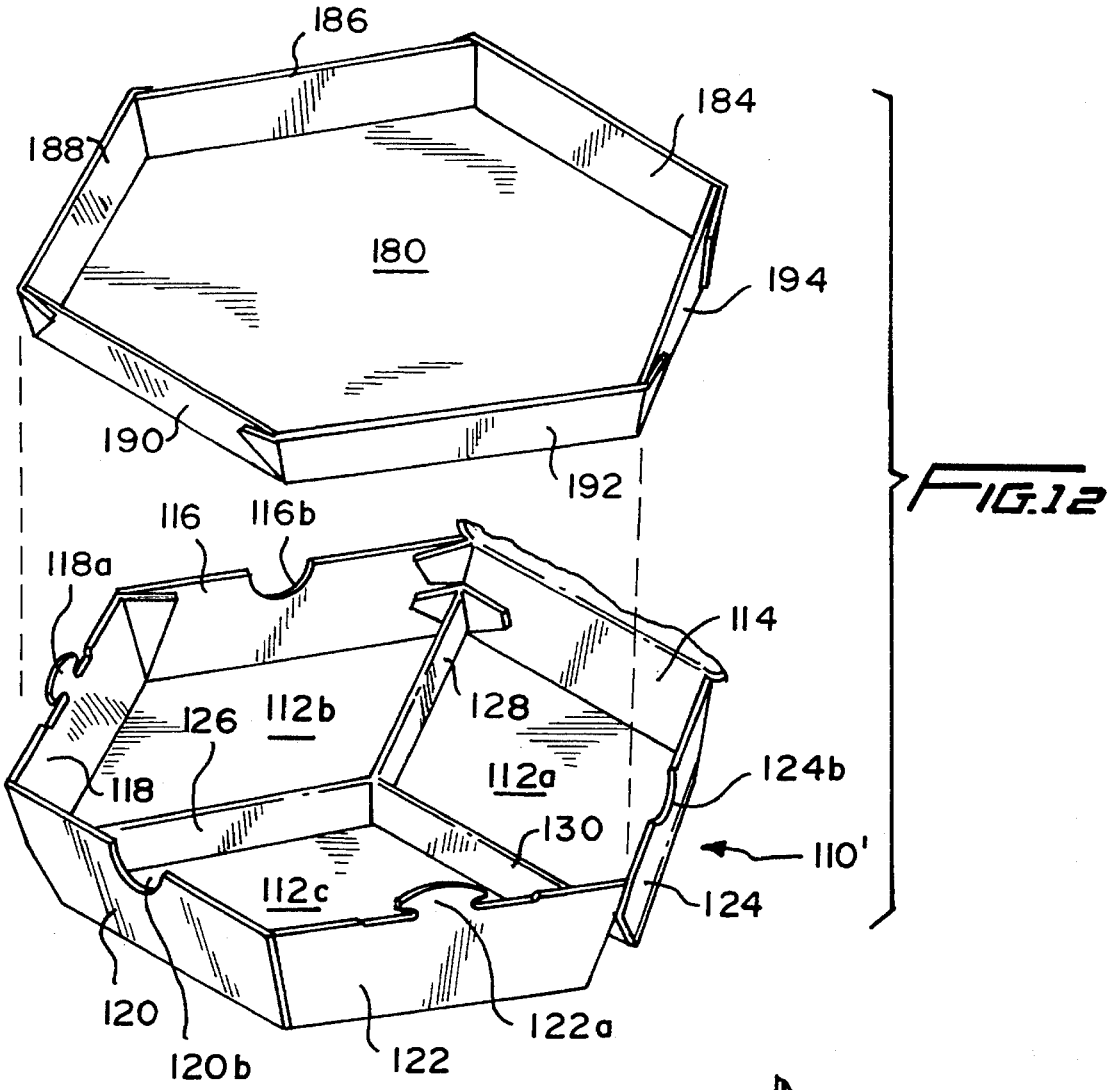
FIG. 12 is a right side perspective view of an open meal tray in combination with an additional tray which is insertable into the interior of the open meal tray.
Figure 13:
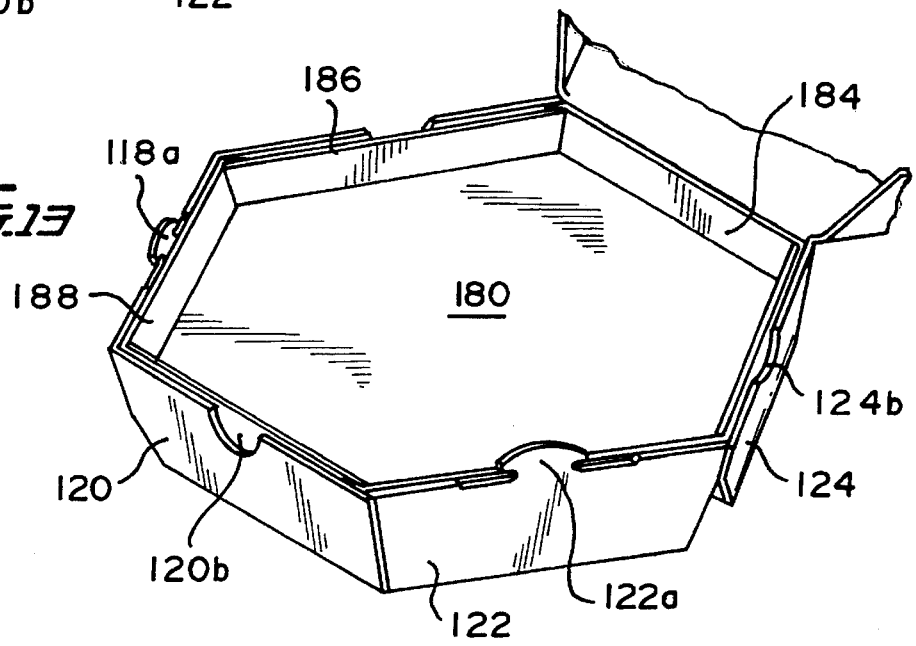
FIG. 13 is a right side perspective view of an open meal tray with the additional tray inserted into the interior thereof.

FIG. 12 is a right side perspective view of an open meal tray in combination with an additional tray which is insertable into the interior of the meal tray, while FIG. 13 is a right side perspective view of the open meal tray with the additional tray inserted into the interior thereof. Since FIGS. 12 and 13 are, in part, similar to FIG. 6, identical reference numerals have been used where appropriate.

As seen in FIG. 12, additional tray 180 has sidewalls 184, 186, 188, 190, 192 and 194, and the additional tray 180 is dimensioned so as to coincide in size with the periphery of container 110', formed by sidewalls 114, 116, 118, 120, 122 and 124 thereof.

It should be further noted that the partitions 126, 128 and 130 have a height substantially less than (preferably, approximately one-half) the height of the sidewalls 114, 116, 118, 120, 122 and 124. Furthermore, the sidewalls 184, 186, 188, 190 and 192 of additional tray 180 are so dimensioned (preferably, approximately one-half the height of sidewalls 114, 116, 118, 120, 122 and 124 of container 110') that the additional tray 180 can be inserted into and fits easily within the upper portion of container 110' (see FIG. 13), the additional tray 180 being supported by partitions 126, 128 and 130 located below (see FIG. 12).

Further referring to FIGS. 12 and 13, in this embodiment of the invention, sidewalls 116, 120 and 124 have upper edges which are discontinuous so as to form notches 116*b*, 120*b* and 124*b*, respectively, therein. Notches 116*b*, 120*b* and 124*b* serve to provide the user with easy access for the purpose of grasping the additional tray 180 when the user desires to remove the additional tray 180 from its position in the upper portion of container 110'. The notches 116*b*, 120*b* and 124*b* shown in FIG. 12 are semi-circular in nature, but it is to be understood that notches of any shape may be employed to provide the user with easy access to the additional tray 180.

Figure 14:
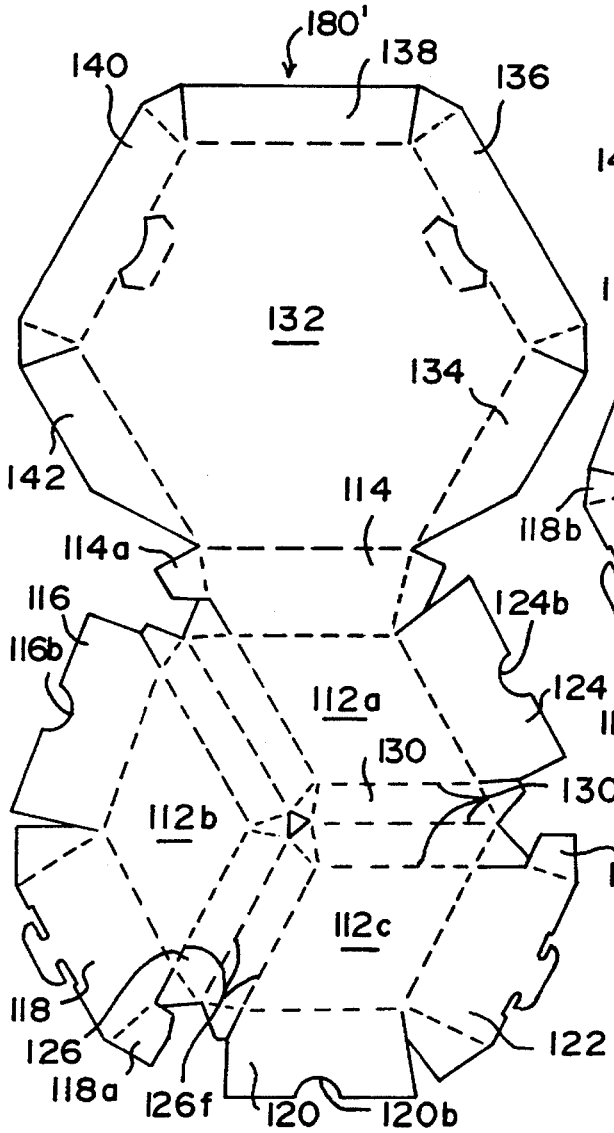
FIG. 14 is a plan view of a blank used in assembling the meal tray shown in FIGS. 12 and 13.

FIG. 14 is a plan view of a blank used to form the meal tray shown in FIGS. 12 and 13. In view of the similarity between the blank of FIG. 14 and the blank of FIG. 8, identical reference numerals have been utilized where appropriate. Assembly of the container of FIGS. 12 and 13 from the blank of FIG. 14 is similar to the assembly of the container of FIGS. 6 and 7 from the blank of FIG. 8, as previously described. Therefore, no further description of the assembly of the container of FIGS. 12 and 13 from the blank of FIG. 14 is believed to be necessary, the assembly being obvious to a person of skill in the art from a reading of the above description relating to FIGS. 6, 7 and 8.

Figure 15:
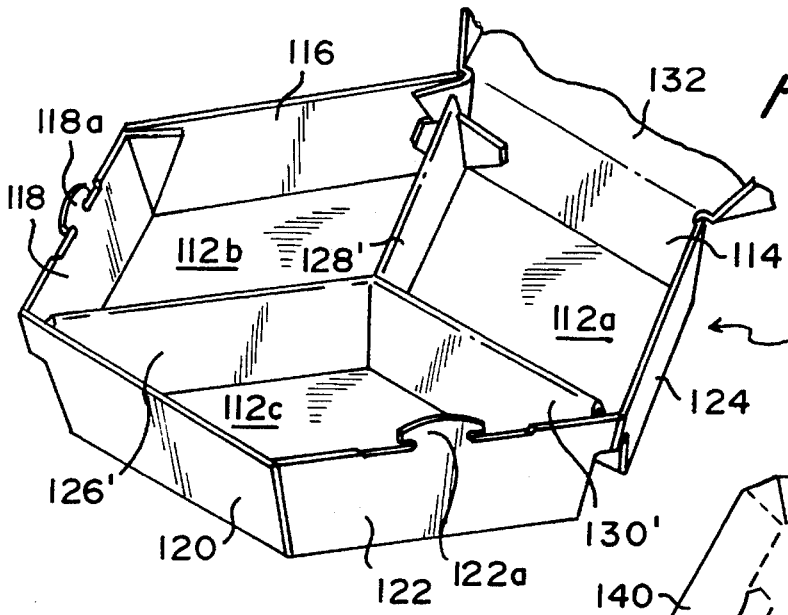
FIG. 15 is a right side perspective view of an open meal tray having partitions which have a height substantially equal to the height of the sidewalls of the tray.

FIG. 15 is a right side perspective view of an open meal tray having partitions which have a height substantially equal to the height of the sidewalls of the tray. Since the open meal tray shown in FIG. 15 is similar to the open meal tray shown in previous FIG. 6, identical reference numerals have been utilized where appropriate.

As seen in FIG. 15, the container 110" has a periphery formed by sidewalls 114, 116, 118, 120, 122 and 124, and a cover 132 connected in hinge-like fashion to the top edge of sidewall 114. Container 110" is provided with partitions 126', 128' and 130' which, in contrast to the partitions 126, 128 and 130 of FIGS. 12 and 13, have a height substantially identical to the height of sidewalls 114, 116, 118, 120, 122 and 124. As a result, foodstuffs of different types inserted into compartments 112*a*, 112*b* and 112*c* will remain in those respective compartments without any intermingling, especially when the cover 132 is secured in the closed position.

Figure 16:
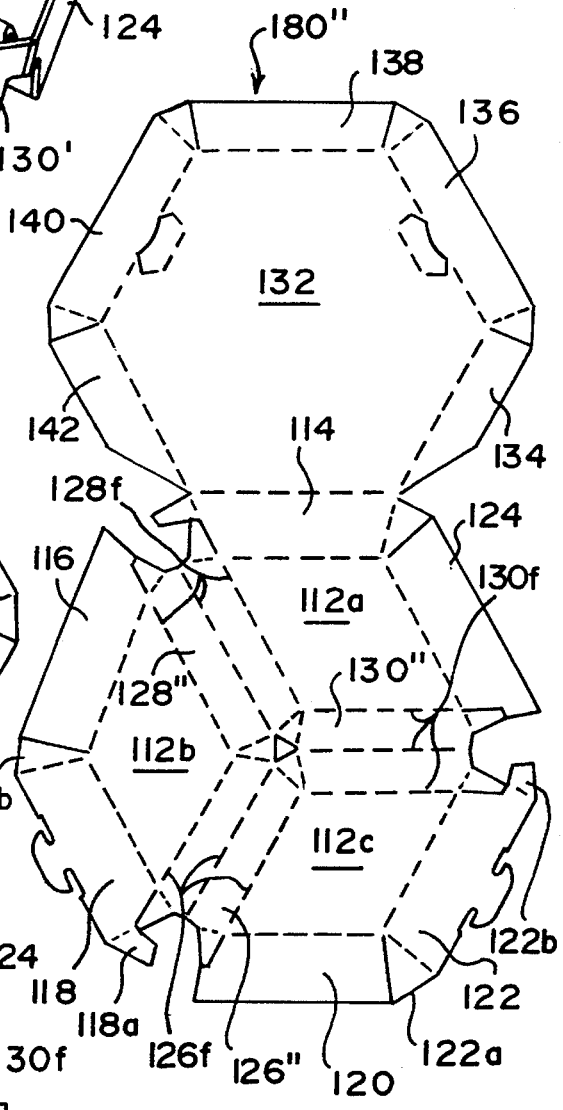
FIG. 16 is a plan view of a blank used in assembling the meal tray of FIG. 15.

FIG. 16 is a plan view of a blank used in assembling the meal tray of FIG. 15. Since the blank of FIG. 16 is similar to the blank of FIG. 8, identical reference numerals have been used where appropriate.

Assembly of the blank of FIG. 16 to form the open meal tray of FIG. 15 is similar to the assembly of the blank of FIG. 8 to form the open meal tray of FIGS. 6 and 7. Accordingly, no additional description of the formation of the blank of FIG. 16 to form the open meal tray of FIG. 15 is believed to be necessary, such assembly being obvious to a person of skill in the art from a reading of the above description relating to FIGS. 6, 7 and 8.

As indicated above, the additional embodiments of an open meal tray shown in FIGS. 12 and 15 are modifications to the previously described open meal tray of FIG. 6. As also indicated above, the modifications necessary to obtain the open meal tray of FIG. 12 from the previously described open meal tray of FIG. 6 comprise the provision of an additional tray 180 (FIG. 12), the provision of notches 116*b*, 120*b* and 124*b* in the upper edge portions of the sidewalls 116, 120 and 124, respectively, and the employment of the lower-height partitions 126, 128 and 130. Furthermore, the modifications necessary to obtain the open meal tray of FIG. 15 from the previously described open meal tray of FIG. 6 comprise the provision of full-height partitions 126', 128' and 130' (FIG. 15), the height of those partitions being virtually identical to the height of the sidewalls 114, 116, 118, 120, 122 and 124 of the container 110" of FIG. 15.

It is to be understood that further embodiments of the invention can be obtained by applying these same modifications to the open meal tray of FIG. 1, as well as to the open meal tray of FIG. 9. It is also to be understood that blanks for forming these further embodiments by modification of the open meal trays of FIGS. 1 and 9 can be derived in a manner similar to the manner in which the blanks of FIGS. 14 and 16 were derived, the development of the blanks for such further embodiments of the invention being obvious to a person of skill in the art based on a study of the disclosure of the invention as contained herein.

While preferred forms and arrangements have been shown in illustrating the invention, it is to be understood that various modifications can be made without departing from the spirit and scope of this disclosure. For example, as previously mentioned, further embodiments of the open meal trays disclosed in FIGS. 1 and 9 can be derived by providing additional trays for insertion into the interior of the open meal trays of FIGS. 1 and 9, such being possible by employing the lower-height partitions disclosed in FIGS. 1 and 9. Furthermore, easy access to the inserted additional trays can be provided by the formation of notches in one or more of the sidewalls of the open meal trays of FIGS. 1 and 9, as described above relative to the embodiment disclosed in FIG. 12. Finally, the open meal trays of FIGS. 1 and 9 can be modified by the provision of full-height partitions within the interior of such open meal trays, this being an obvious modification based on the description of the development of the embodiment of FIG. 15, set forth above.

I claim:

1. A container for holding food products, said container being defined from a unitary blank and comprising a planar base and a plurality of straight, equal length sidewalls having respective bottom edges integrally joined to said planar base, each of said sidewalls having opposed ends joined at an obtuse angle to corresponding ends of adjacent sidewalls to define corners, said plurality of sidewalls and said corners defining a periphery of said container;

said container further comprising a plurality of integral internal partitions extending along said planar base, each of said internal partitions having first and second ends, at least two of said internal partitions each having its first end joined to a respective one of said corners, said at least two of said internal partitions having their second ends joined together, a further one of said internal partitions having a first end joined to said periphery of said container and a second end joined to said second ends of said at least two of said internal partitions.

2. The container of claim 1, wherein said further one of said internal partitions has its first end joined to a further one of said corners.

3. The container of claim 1, wherein said plurality of sidewalls comprises:

a first sidewall having first and second ends;

second and third sidewalls, each having a first end joined to said first and second ends, respectively, of said first sidewall to form first and second corners, respectively, each of said second and third sidewalls having a second end;

fourth and fifth sidewalls, each having a first end joined to said second end of said second and third sidewalls, respectively, to form third and fourth corners, respectively, each of said fourth and fifth sidewalls having a second end; and a sixth sidewall having first and second ends joined to said second ends of said fourth and fifth sidewalls, respectively, to form fifth and sixth corners, respectively.

4. The container of claim 3, wherein said at least two of said internal partitions have their first ends joined to said third and fourth corners, respectively, and wherein said further one of said internal partitions has its first end joined to said fifth corner.

5. The container of claim 3, wherein said at least two of said internal partitions have their first ends joined to said first and fourth corners, respectively, and wherein said further one of said internal partitions has its first end joined to said fifth corner.

6. The container of claim 1, wherein said further one of said internal partitions has its first end joined to a respective one of said sidewalls.

7. The container of claim 1, wherein said plurality of sidewalls comprises:

a first sidewall having first and second ends;

second and third sidewalls, each having a first end joined to said first and second ends, respectively, of said first sidewall to form first and second corners, respectively, each of said second and third sidewalls having a second end; and fourth and fifth sidewalls, each having a first end joined to said second end of said second and third sidewalls, respectively, to form third and fourth corners, respectively, each of said fourth and fifth sidewalls having a second end, said second ends of said fourth and fifth sidewalls being joined to each other to form a fifth corner.

8. The container of claim 7, wherein said at least two of said internal partitions have their first ends joined to said third and fifth corners, respectively, and wherein said further one of said internal partitions has its first end joined to said third sidewall.

9. The container of claim 1, wherein each of said first ends of said at least two of said internal partitions including a pair of laterally and oppositely directed tabs overlying and affixed to adjacent portions of said adjacent sidewalls defining the corresponding corner wherein said adjacent sidewalls and the corresponding corner are directly engaged, supported and rigidified.

10. The container of claim 1, wherein each of said sidewalls has a height and each of said internal partitions has a height, the height of said internal partitions being substantially equal to the height of said sidewalls.

11. The container of claim 1, wherein each of said sidewalls has a height and each of said internal partitions has a height, the height of said internal partitions being less than the height of said sidewalls, a tray removably received in said container on and supported from below by said internal partitions, and a lid integral with one of said sidewalls and selectively movable between a first position overlying and closing said tray, and a second position remote from said tray.

12. A container for holding food products, said container comprising a unitary meal tray and lid, said tray comprising a planar base and a periphery of a predetermined height and formed of peripheral sidewalls having bottom edges joined to said planar base, said tray further comprising at least two internal partitions extending along said planar base, said at least two internal partitions each having a first end connected to said periphery, said at least two internal partitions having a height less than the predetermined height of said periphery;

said container further comprising an additional tray removably received in said meal tray in supported engagement on said at least two internal partitions, said partitions supporting said additional tray within said meal tray, said at least two partitions and said additional tray having a combined height approximately equal to said predetermined height of said periphery of said meal tray;

said lid being integral with one of said side walls and selectively movable between a first position overlying and closing said meal tray with said additional tray supported therein, and a second position remote from said meal tray.

13. A unitary blank adapted to be folded to form a container for holding food products, said container comprising a tray having multiple sections defined by integral interior partitions and a lid integral with said tray and closeable thereover;

said blank comprising a tray panel and a lid panel, said tray panel comprising a planar base portion and a plurality of linear sidewall portions having edges meeting said planar base portion at fold lines, each of said sidewall portions having two free ends, adjacent ends of adjacent sidewall portions forming respective obtuse corner portions, said plurality of said sidewall portions and said respective obtuse corner portions defining a periphery of said blank;

said blank further comprising three partition portions within said tray panel and dividing said tray panel into respective compartment portions, each of said partition portions being defined by laterally spaced parallel fold lines and having first and second ends, two of said partition portions meeting respective ones of said corner portions, said first end of a third one of said partition portions meeting said periphery of said blank, said second ends of said partition portions meeting centrally on said tray panel;

said lid panel being integral with one of said sidewall portions and substantially coextensive with the length thereof.

14. The blank of claim 13 wherein said plurality of sidewall portions comprising a first sidewall portion having first and second ends;

second and third sidewall portions, each having a first end meeting said first and second ends, respectively, of said first sidewall portion to form first and second corner portions, respectively, each of said second and third sidewall portions having a second end;

fourth and fifth sidewall portions, each having a first end meeting said second end of said second and third sidewall portions, respectively, to form third and fourth corner portions, respectively, each of said fourth and fifth sidewall portions having a second end; and a sixth sidewall portion having first and second ends meeting said second ends of said fourth and fifth sidewall portions, respectively, to form fifth and sixth corner portions, respectively;

said three partition portions have their first ends meeting said third, fourth and fifth corner portions, respectively, said compartment sections formed by said partition portions being of three different sizes;

said partition portion meeting said fourth corner portion comprises two laterally adjacent elongate sections with a cut line therebetween allowing for separate folding and overlapping of said sections, said sections being of substantially equal length and longitudinally offset from each other.

15. The blank of claim 13, wherein each of said first ends of said three partition portions has a pair of tab portions thereon, said tab portions being free of adjacent sidewall portions and being foldable relative to the respective first ends so as to flatly overlie adjacent sidewall portions of said periphery of said blank when said blank is folded to form a container.

16. The blank of claim 13, wherein said plurality of sidewall portions comprises:

a first sidewall portion having first and second ends;

second and third sidewall portions, each having a first end meeting said first and second ends, respectively, of said first sidewall portion to form first and second corner portions, respectively, each of said second and third sidewall portions having a second end; and fourth and fifth sidewall portions, each having a first end meeting said second end of said second and third sidewall portions, respectively, to form third and fourth corner portions, respectively, each of said fourth and fifth sidewall portions having a second end, said second ends of said fourth and fifth sidewall portions meeting each other to form a fifth corner portion, said two of said partition portions have their first ends meeting said third and fifth corner portions, respectively, and said third partition portion having its first end meeting said third sidewall portion and forming said compartment portions in three different sizes.

17. A unitary blank adapted to be folded to form a container for holding food products, said container comprising a tray having multiple sections defined by integral interior partitions and a lid integral with said tray and closeable thereover;

said blank comprising a tray panel and a lid panel, said tray panel comprising a planar base portion and a plurality of linear sidewall portions having edges meeting at fold lines to said planar base portion, each of said sidewall portions having two free ends, adjacent ends of adjacent sidewall portions forming respective corner portions, said plurality of said sidewall portions and said respective obtuse corner portions defining a periphery of said blank;

said blank further comprising three partition portions within said tray panel and dividing said tray panel into respective compartment portions, each of said partition portions being defined by laterally spaced parallel fold lines and having first and second ends, two of said partition portions having the first ends thereof meeting respective ones of said corner portions, said first end of a third one of said partition portions meeting one of said sidewall portions centrally thereof, said second ends of said partition portions meeting centrally on said tray panel.

18. The blank of claim 17 wherein said third partition portion comprises two laterally adjacent elongate sections with a cut line therebetween allowing for separate folding and overlapping of said sections, said sections being of substantially equal length and longitudinally offset from each other, said one of said sidewall portions with which said third one of said partition portions meet being defined by two longitudinal sections longitudinally and laterally offset from each other and alignable to form a common sidewall upon a folding of said blank.

19. The blank of claim 17, wherein each of said first ends of said three partition portions has a pair of tab portions thereon, said tab portions being free of adjacent sidewall portions and being foldable relative to the respective first ends so as to flatly overlie adjacent sidewall portions of said periphery of said blank when said blank is folded to form a container.

* * * * *